United States Patent [19]

Norden

[11] Patent Number: 4,872,855

[45] Date of Patent: Oct. 10, 1989

[54] ADJUSTABLE TERMINAL BLOCK EQUIPMENT

[75] Inventor: Alexander R. Norden, New York, N.Y.

[73] Assignee: Connectron, Inc., Laurence Harbor, N.J.

[21] Appl. No.: 202,801

[22] Filed: Jun. 3, 1988

[51] Int. Cl.[4] ..... H01R 9/22

[52] U.S. Cl. ..... 439/717; 439/713

[58] Field of Search ..... 439/709, 712, 715, 717, 439/718, 713, 714, 491, 601, 686, 701

[56] References Cited

U.S. PATENT DOCUMENTS 3,259,876 7/1966 Norden ..... 439/716

4,343,528 8/1982 Lucius ..... 439/601

4,425,018 1/1984 Stenz ..... 439/716

*Primary Examiner*—Neil Abrams

*Assistant Examiner*—Khiem Nguyen

[57] ABSTRACT

An assembly of one, two or more rows of terminal blocks are movable to allow limited extension and contraction of each row so that the spacing of terminals of a row of the terminal blocks can be varied. A selected form of elongated member has spaced-apart formations that cooperate with the respective terminal blocks to fix the terminals of the row of terminal blocks at inch-based modular positions or at millimeter-based modular positions corresponding to the spacing of electrical equipment terminals.

26 Claims, 3 Drawing Sheets

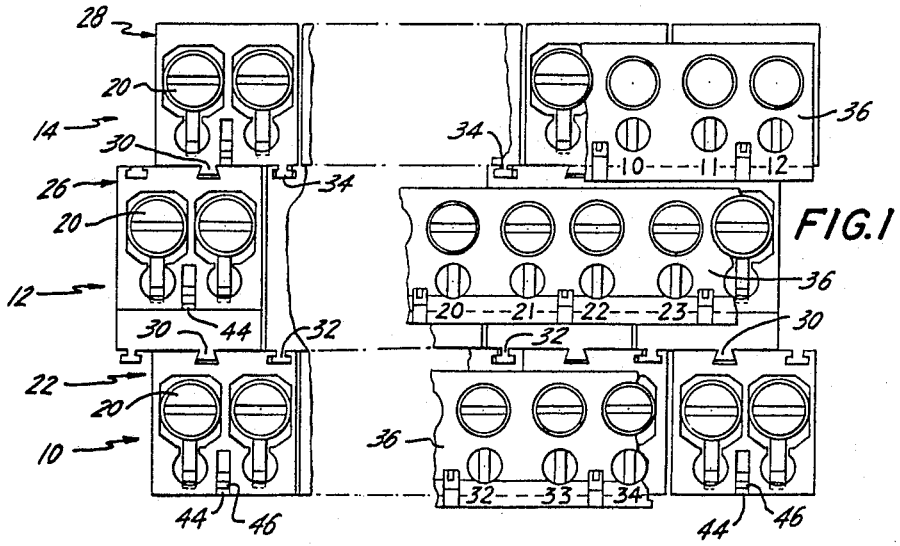
FIG.1
FIG.4
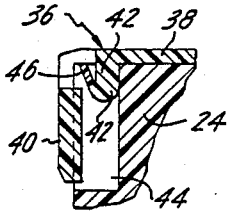
FIG.6
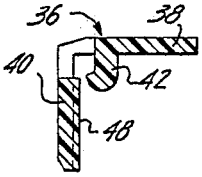
FIG.7
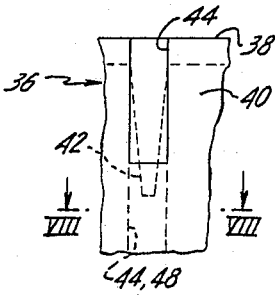
FIG.5
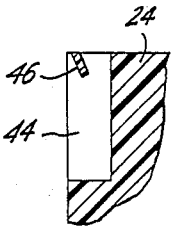
FIG.8
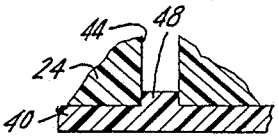

ADJUSTABLE TERMINAL BLOCK EQUIPMENT

The present invention relates to electrical terminal blocks, separately and as part of electrical apparatus.

Apparatus for making many circuit connections has been made for many years in the form of multiple unitary terminal blocks that are assembled in a row. The number of terminal blocks required corresponds to the number of circuits in the electrical apparatus equipped with the terminal blocks. As an example, my U.S. Pat. No. 3,259,876 issued July 5, 1966 shows how modular terminal blocks can be distributed at fixed positions along a common mounting rail.

The terminal blocks in that patent have circuit connectors, each having wire grippers at its opposite ends. Wires from a piece of circuit equipment enter one set of wire grippers at one side of the assembled terminal blocks. The wire grippers at the opposite side of the terminal block assembly are available for making external wired connections.

In another practice, a long terminal strip has a row of many terminals at one side for plug-in or soldered connection to corresponding equipment terminals and it has wire grippers at its opposite side. The spacing between each of the plug-in or solder terminals, and the overall length of a row of those terminals must match the spacing and overall extent of the equipment terminals. Different lengths of terminal strips may be manufactured for various units of electrical equipment. The same range of different lengths of terminal strips may be required for electrical equipment having either of two standards of modular spacing of a row of terminals, one range of various terminal strips in an inch-based system and another range of terminal strips in a millimeter-based system.

The present invention adapts a single form of terminal block or circuit connecting device to both inch-based and millimeter-based modular terminal configurations of the electrical equipment.

In an example, it may be considered that a single terminal block contains two circuit connectors, and those connectors have pin terminals whose spacing is fixed. The pin terminals are intended to mate with close-spaced equipment terminals. Usual tolerances of the equipment terminal pattern and the pin terminals of the terminal block are such that there may be no problem of the pin terminals mating with the equipment terminals, even if the modular standard of the terminal block is inch-based and the modular standard of the equipment terminals is millimeter-based. There may be a deviation of only 0.003 inch in an example between one terminal and the next when comparing inch-based and millimeter-based modular configurations of equipment terminals. This deviation may well be inconsequential; mating may not be impeded. However, if many terminal blocks are assembled in a row, the deviation between inch-based modular spacing and millimeter-based modular spacing is cumulative. A terminal block assembly in either modular system (inch-based or millimeter-based) may introduce a deviation of many times 0.003 inch when used with electrical equipment having a terminal configuration based on the opposite modular system.

In one aspect, the present invention provides modular terminal blocks or connecting devices in a row or multiple parallel rows that are held together in an assembly but in which the length of the row(s) is variable to a limited extent to accommodate both inch-based modular spacing and millimeter-based modular spacing of the terminals at one side of the assembly. In another aspect, the present invention provides assembled terminal blocks in a row or rows wherein the distribution of the circuit connectors of a row is precisely fixed by a unifying member or members so that all the terminals of the terminal block assembly are aligned with terminals of the electrical equipment.

In a still further aspect of the invention, the invention provides assembled electrical apparatus that includes electrical equipment having at least one row of terminals, in combination with an assembled row or rows of terminal blocks wherein each terminal block has no more than a few circuit connectors, the assembled terminal blocks having terminals distributed in a row or rows and having one or more unifying members that establish a distribution of the circuit connectors that corresponds to the distribution of the terminals of the electrical equipment.

In one practical form, the assembled terminal blocks have circuit connectors each of which has a screw-fastener and a projecting pin terminal; and because the distribution of each row of pin terminals is fixed by a unifying member or members in accordance with inch-based or millimeter-based standards, the assembled terminal blocks provide a pattern of pin terminals that mate directly with a corresponding modular pattern of inch-based or millimeter-based equipment terminals.

The apparatus described in detail below and shown in the accompanying drawings is an illustrative embodiment of various aspects of the invention.

IN THE DRAWINGS

FIGS. 1 and 2 are greatly enlarged fragmentary top plan and front views, respectively, of a novel terminal block assembly embodying various aspects of the invention;

FIG. 4 is a cross-section of a detail of FIG. 2 as seen at the plane IV—IV in FIG. 2, drawn to larger scale;

FIGS. 5 and 6 are cross-sections of the components of FIG. 4, drawn to the same scale and viewed at the same plane;

FIG. 7 is a greatly enlarged detail of FIG. 2;

FIG. 8 is a cross-section of components shown in FIG. 7, as seen at the plane VIII—VIII of FIG. 7.

FIGS. 1–3 represent a terminal block assembly for making wire connections to a pattern of terminals of electrical equipment represented in FIG. 9, e.g. the printed circuit board in FIG. 3. The equipment terminals can accommodate only limited misalignment (e.g. about three-thousandths of an inch) with the terminals of the terminal block assembly.

Figure 2:
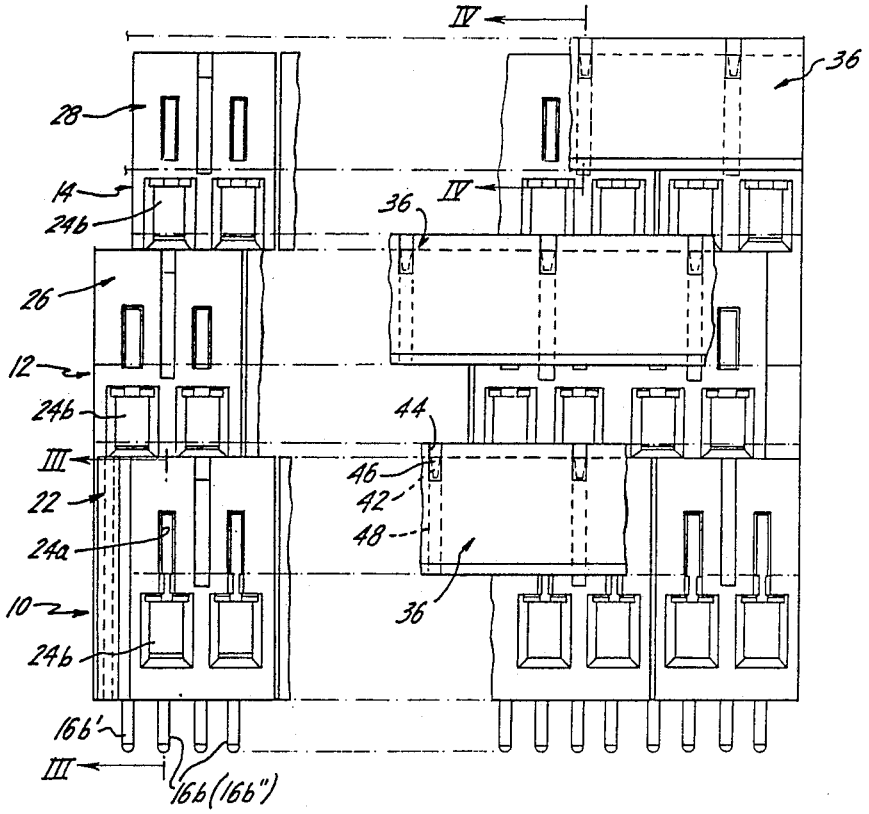

The illustrative terminal block assembly includes three rows of modular terminal blocks 10, 12 and 14. In this example, each row of terminal blocks comprises six terminal blocks each of which has two circuit connectors, so that there are twelve connectors in each row. As appears below, each connector in this example provides a pin terminal and a wire fastener, for connecting a wire to an equipment terminal.

A typical circuit connector (FIG. 3) includes a stationary conductor 16 having a horizontal contact portion 16*a*, a downward projecting pin terminal 16*b* and a resilient detent 16*c*. Contact portion 16*a* extends between the top and bottom walls and between the side walls of a four-wall clamp 18. Screw 20 extends through the threaded double-thick top wall of clamp 18. The lower end of screw 20 bears against the top of contact portion 16*a*. As the screw is tightened, it draws the bottom wall or jaw of clamp 18 upward, so that an inserted wire is gripped between the clamp's jaw and contact portion 16*a*. This form of screw-operated clamp and stationary contact constitutes an excellent, well-known form of wire gripper.

Each terminal block 22 of row 10 includes two connectors 16, 18, 20 which are entirely contained in a body of molded insulation 24 except for projecting pin terminal 16*b*. Detent 16*c* is received in a hole 24*a* in the insulating body, holding conductor 16 in place. A wire (not shown) enters the connector via an opening 24*b*.

Rows of terminal blocks 26 and 28 behind row 22 are successively taller than terminal blocks 22. Terminal blocks 26 and 28 have the same construction as terminal block 22, except for their different heights. The parts of all the terminal blocks that are identical bear the same numerals, while corresponding parts that are different bear the same numerals, distinguished by (') and ("). Because terminal blocks 26 of row 12 are taller than blocks 22 of row 10, circuit wires can extend over terminal blocks 22 for insertion into respective openings 24*b* of terminal blocks 26. Each inserted wire is gripped by screw-operated clamp 18 and contact portion 16*a* of a connector in block 26. Each conductor 16' in blocks 26 is elongated, to reach its projecting pin terminal 16b'.

Correspondingly, terminal blocks 28 of row 14 have openings 24*b* at the left (FIG. 3) so that wires can extend over terminal blocks 26 and into terminal blocks 28, to be gripped by parts 16" and 18 of those terminal blocks. Conductors 16" of terminal blocks 28 are long enough to reach pin terminals 16*b"* that project downward from the common bottom plane of all three rows of terminal blocks.

As seen in FIG. 1, terminal block 26 at the left end of row 12 is offset in relation to the terminal block 22 at the left end of row 10. All of the other terminal blocks of these two rows are offset correspondingly. The connectors contained in the terminal blocks 26 of row 12 are correspondingly offset from the two connectors in the terminal blocks 22 of row 10. One benefit of this offset relationship is that wiring is made easier. Wires entering terminal blocks 26 do not obstruct access to screws 20 of the connectors of terminal blocks 22. Terminal blocks 26 of row 12 are also offset relative to terminal blocks 28 of row 14, with the resulting ease of wiring. Wires entering any terminal block 28 do not obstruct access to screws 20 of terminal blocks 26. While wires entering terminal blocks 28 may extend over screws 20 of terminal blocks 22, blocks 28 are so much taller than blocks 22 that access to the screws of the shorter blocks 22 is not difficult.

The left-hand terminal blocks 22 and 26 are unified by a dovetail joint 30 (FIGS. 1 and 3) and the left-hand terminal blocks 26 and 28 are also unified by a dovetail joint 30. These dovetail joints constitute formations that unify the terminal blocks of the three rows 10, 12 and 14 in groups of three.

If an assembly of only two rows of terminal blocks is needed, row 14 can be omitted. Blocks 22 and 26 remain unified in pairs. As another option, row 12 could be omitted, and in that event, the terminal blocks 28 would be aligned with terminal blocks 22 and unified in pairs by their dovetail joints 30.

The terminal blocks of each row are movable toward and away from each other to a limited extent, and the groups of three unified terminal blocks 22, 26 and 28 (as well as unified pairs) are correspondingly movable toward and away from each other to a limited extent. This controlled limited movement results from interlocking formations 32 of blocks 22 and 26 and interlocking formations 34 of terminal blocks 26 and 28. Each of these interlocking formations involves what may be called a spline on one block that is received in a generally complementary groove in the other. The dimensions of the spline are narrower than the corresponding dimensions of the groove, in the direction parallel to the lengths of the rows. For this reason, each block of each row, and each group of unified blocks, is movable toward and away from its neighboring or next-adjacent block(s) or group(s). (The end blocks of each row, of course, have only one next-adjacent block and they are movable toward and away from only one next-adjacent block; hence the terms "block(s)" and "group(s)" are useful.)

These interlocking formations that allow limited lengthening and contraction of each row of terminal blocks, as well as lengthening and contraction of all the rows of blocks, might be simple ribs that only limit such lengthening and contraction. In this example, their cross-section is T-shaped. The wide portion of the groove in one block that receives the cross-bar of the "T" is wider (horizontally, FIG. 1) than the length of the cross-bar, and the slot of that groove which receives the center bar of the "T" is wider than that center bar. Accordingly, the T-shaped formations allow limited movement—e.g., 0.012 inch—of each terminal block relative to its neighbor(s). However, the top cross-bar of the "T" has a snug sliding fit (horizontal in FIG. 1) in its receiving portion of the groove formation. Therefore, those interlocking T-shaped formations not only allow each row of terminal blocks to lengthen and contract, but they complement joints 30 in holding each row of terminal blocks in assembly to its adjacent row(s) of terminal blocks. To like effect, the T-shaped interlocking formations may be L-shaped.

The left-hand end terminal block 28 in row 14 has an interlocking formation 34 retaining it assembled to the second-from-left terminal block 26 of row 12 due to the offset relationship of the terminal blocks 26 relative to blocks 28. In the same way, interlocking formations 32 are formed between the left-hand end terminal block 22 of row 10 and the second-from-left terminal block 26 of row 12, due to their offset relationshp. These interlocking formations 32 and 34 interconnect each terminal block of a row with the next adjacent block(s) of the row and they interconnect each group of three unified blocks 22, 26 and 28 in the same way. When either row 10 or row 14 of terminal blocks 22 or blocks 28 is omitted, the described interlocking formations 32 or 34 still accomplish the same purposes.

FIGS. 1–4 show three members 36 that have two basically flat webs 38 and 40 that meet at a corner. One web 38 rests on the top of a respective row of terminal blocks 22, 26 or 28 and the other web 40 abuts the front face of that row of terminal blocks. (See FIGS. 7 and 8.)

Each "top" web 38 has a vertical (FIGS. 6 and 7) hook or detent 42 that is thick at its top end where it extends from web 38, and it is thin at its opposite, lower hooked end. Each terminal block has a slot 44 extending downward from its top and along its front. There is a deformable web 46 (FIG. 5) extending across slot 44 from one side to the other. This web 46 is for example an integral portion of the insulating body of each terminal block, respectively (e.g., body 24). Web 46 is tough, deformable and resilient, being part of body 24 as of nylon. Member 36 has multiple hooks 42 distributed along its length, located to be received in slots 44 of the terminal blocks. Member 36 is of a relatively rigid dimensionally stable molded plastic, for example polyethylene terephthalate. When hooks 42 are forced into the spaces behind webs 46, member 36 becomes locked to a row of terminal blocks, with top web 38 against the tops of a respective row of terminal blocks.

The front web 40 of member 36 has a series of ribs 48 (FIG. 8) that are snugly received in grooves 44 of respective terminal blocks. Ribs 48 are aligned with hooks 42. Hooks 42 (like ribs 48) fit snugly across the width of slots 44. Both the hooks 42 and the ribs 48 of each elongated member fix the terminal blocks of a row against relative movement along the row.

Two differently dimensioned forms of member 36 are provided. In one form, hooks 42 and ribs 48 are at spaced intervals that fix the terminal blocks of a row close together, while in another form of member 36, hooks 42 and ribs 48 fix the terminal blocks of a row in precise spaced-apart relationship. The blocks of a row are close together when a desired minimum spacing is established between their row of pin terminals **16*b*, 16*b*' or 16*b*''. Blocks that are close may abut one another but it is advantageous to allow some space between them. (If the blocks were designed to be in abutment, the row of blocks in practice could be over-size due to manufacturing variations and the effects of changing temperature and humidity.) Each form of member 36 correspondingly determines the distribution of each row of pin terminals 16*b*, 16*b*' or 16*b*''. One form of member 36 fixes terminals 16*b*, 16*b*' and 16*b*'' at millimeter-based positions. Another form of member 36 has its hooks 42 and ribs 48 spaced apart at modular inch-based positions that fix pin terminals 16*b*, 16*b*' and 16*b*'' correspondingly. The length of each member 36 is cut to conform to the desired length of the row of terminal blocks to which it is assembled. In this way, each row of pin terminals 16*b*, as well as pin terminals 16*b*' and 16*b*'' are spaced apart for direct cooperation with a respective row of apertures that constitute terminals 50, 50' and 50'' of the electrical equipment 52, whether its design is inch-based or millimeter-based. The electrical equipment here is (or comprises) a printed circuit board 52 for example. The pattern of pin terminals 16*b*, 16*b*' and 16*b*'' is established by members 36** before the assembled terminal blocks are mounted on the printed circuit board.

Figure 3:
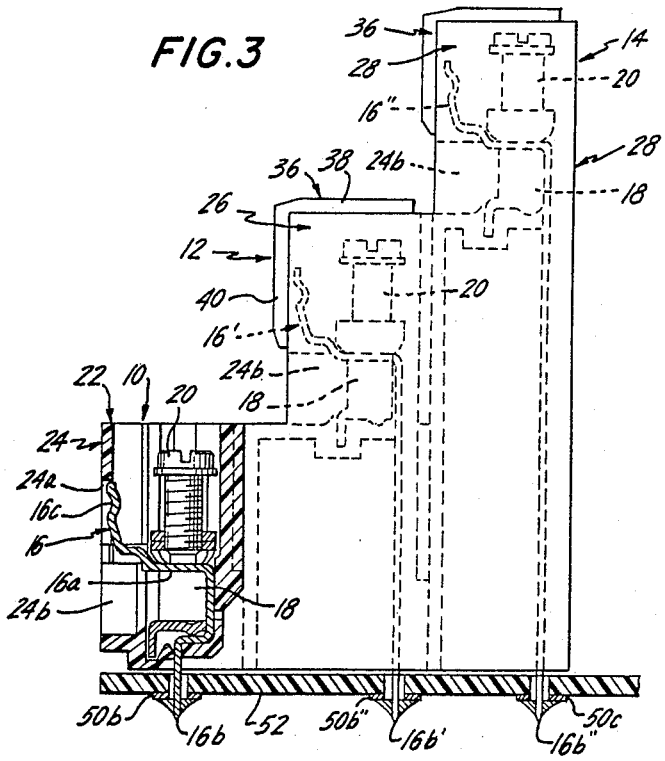
FIG. 3 is a right-side elevation of the terminal block assembly of FIGS. 1 and 2 together with a printed-circuit board shown in cross-section, a portion of the terminal block assembly of FIG. 3 being shown in cross-section as seen at the plane III—III of FIG. 2.
Figure 9:
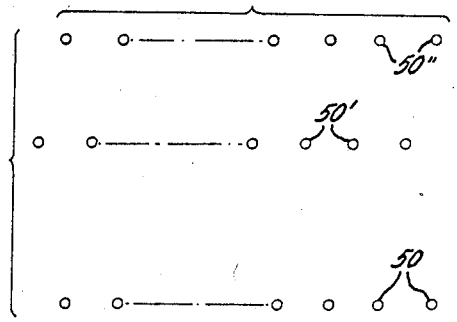
FIG. 9 is a diagram of the terminals of the printed circuit board of FIG. 3.

Considering FIG. 3, the row-to-row separation of pin terminals **16*b*, 16*b*' and 16*b*'' will be somewhat different when designed pursuant to inch-based standards or millimeter-based standards. The elongated conductors bearing pin terminals 16*b*' and 16*b*'' are amply flexible and they are movable to some extent toward and away from pin terminals 16*b***, to be deflected (as may be needed) for alignment with the respective rows of the equipment terminals.

FIGS. 1–3 are drawn to scale, substantially enlarged, and FIGS. 4–6 are similarly drawn to a different enlarged scale. The width of each terminal block 22, 26 and 28 (measured along its row) is 0.390 inch in one example, this being close to 9.9 mm, to provide a center-to-center spacing of 0.200 inch or 5.0 mm between pin terminals **16*b* of a row. Pin terminals 16*b* of any one terminal block, when made to either modular standard (inches or millimeters), may cooperate satisfactorily with equipment terminals having a standardized modular spacing when made to the other modular standard. However, when a number of blocks are assembled in a row, e.g., six blocks, there is an excessive cumulative deviation between terminal blocks made to one modular standard (inches or millimeters) in relation to equipment terminals made to the other modular standard (millimeters or inches). The same terminal blocks serve both inch-based and millimeter-based modular rows of equipment terminals when formed to allow the lengths of the rows to vary and when equipped with a member 36** corresponding to the inch-based or millimeter-based modular terminal distribution of the electrical equipment.

It is evident that the assembly of terminal blocks may be reduced to a single row. In that event, the T-shaped (or L-shaped) interlocking formations 32 are to be interposed (for example) between each block 22 and the next. The shapes of the splines and the grooves are modified, of course, to accommodate limited movement of blocks 22 toward and away from each other while maintaining the front and back surfaces of those blocks in alignment.

The illustrative embodiment of the invention described above and shown in the accompanying drawings, may be modified and variously applied to meet various circumstances, so that the appended claims should be construed broadly, in accordance with the spirit of the invention.

What is claimed is:

1. Apparatus for making electrical connection to either of two different forms of electrical equipment having terminals at respectively different spaced intervals, said apparatus including at least one row of terminal blocks each of which includes at least one connector having a wire fastener and, connected thereto, a connector terminal for mating with a respective one of said equipment terminals, said terminal blocks being movable relatively closer together or farther apart for enabling said connector terminals to be aligned with respective terminals of either form of said electrical equipment, said apparatus having retaining means for holding said terminal blocks of the row assembled yet movable relative to one another so as to provide alternative spacings of the connector terminals along the row.

2. Apparatus as in claim 1, wherein said apparatus comprises two rows of such terminal blocks, each of the terminal blocks of each row being secured to a respective opposite terminal block of the other row to constitute secured pairs of terminal blocks, said retaining means comprising interlocking formations of said terminal blocks that allow only limited shift of each secured pair toward and away from the adjacent secured pair(s) of terminal blocks.

3. Apparatus as in claim 1, wherein said apparatus comprises at least three parallel rows of such terminal blocks including a second row between first and third rows of terminal blocks, each of the terminal blocks of said second row being secured to respective terminal blocks of the first and third rows to constitute groups of at least three secured terminal blocks, said retaining means comprising interlocking formations of the terminal blocks that allow only limited shift of each secured group of blocks toward and away from the adjacent secured group(s) of terminal blocks.

4. Apparatus as in claim 1, further including a member having locating formations cooperable with said row of terminal blocks for determining the spacing of the connector terminals of said terminal blocks of said row to correspond to the spacing of the terminals of one of said forms of electrical equipment.

5. Apparatus as in claim 2, including two elongated members each having locating formations cooperable with the terminal blocks of a respective one of said rows for determining the spacing of the connector terminals of said terminal blocks of each said row to correspond to the spacing of the terminals of one of said forms of electrical equipment.

6. Apparatus as in claim 3, including multiple elongated members each having locating formations cooperable with the terminal blocks of a respective one of said rows for determining the spacing of the connector terminals of said terminal blocks of each said row to correspond to the spacing of the terminals of one of said forms of electrical equipment.

7. Apparatus as in claim 1, wherein said apparatus comprises at least two parallel rows of such terminal blocks, and wherein said retaining means comprises interlocking formations on the terminal blocks of one of said rows in interengagement with generally complementary formations of the terminal blocks of the other of said rows, such interengagement accommodating only limited shift of each terminal block of each row toward and away from the next adjacent terminal block(s) in its row.

8. Apparatus as in claim 1, wherein said apparatus comprises at least three rows of such terminal blocks and wherein said retaining means comprises interlocking formations of the terminal blocks of each of said rows in interengagement with generally complementary interlocking formations of the terminal blocks of the next adjacent row(s) of terminal blocks, such interengagement accommodating only limited shift of each terminal block of each row toward and away from the next adjacent terminal block(s) in its row.

9. Apparatus for making electrical connection to either of two different forms of electrical equipment having terminals at respectively different spaced intervals, said apparatus including at least two parallel rows of terminal blocks, each of said terminal blocks including at least one connector having a terminal for making connection to a respective one of said equipment terminals, said terminal blocks of each row being movable relatively closer together or farther apart for enabling the terminals of said connectors to be aligned with respective terminals of either form of said electrical equipment, the terminal blocks of each row being unified with respective terminal blocks of the next adjacent row(s) so as to constitute a succession of unitary subassemblies, said blocks of each unitary subassembly and the blocks of the next-adjacent unitary subassembly or subassemblies having interengaging formations accommodating only limited shift of each unitary subassembly toward and away from the next-adjacent unitary subassembly or subassemblies of the apparatus.

10. Apparatus as in claim 9, further including multiple elongated members, each elongated member having locating formations cooperable with a respective row of said terminal blocks for establishing that spacing of the terminals of the terminal blocks in each of said rows, respectively, which corresponds to the distribution of the terminals of one of said forms of electrical equipment.

11. Apparatus for making electrical connections to electrical equipment having at least one row of many equipment terminals whose distribution is alternatively at inch-based or metric-based modular intervals along the row, said apparatus including at least one group of terminal blocks having electrical terminals which are distributed along a row and which are distributed for cooperation with said equipment terminals, respectively, said terminal blocks having wire fastening terminals connected to said electrical terminals, respectively, said terminal blocks being movable relative to one another along their row, the electrical terminals of each of said terminal blocks being so limited in number and each electrical terminal being so located on its respective terminal block that the terminals of said terminal blocks are cooperable with respective equipment terminals regardless of whether the distribution of the equipment terminals is at inch-based or metric-based modular intervals, and an elongated locating member assembled to said one row of terminal blocks for fixing the distribution of the terminals thereof, said member having terminal-block locating formations distributed at one of said modular intervals.

12. Apparatus as in claim 11 wherein said elongated located member has detents cooperable with said terminal blocks for retaining the elongated locating member assembled to said terminal blocks with said formations in cooperation with said terminal blocks as aforesaid.

13. Apparatus as in claim 11 wherein said elongated locating member has a top portion and a side portion, one of said portions having a plurality of said terminal-block locating formations for cooperation with complementary formations of said terminal blocks of a row, respectively, and wherein the other of said portions has a plurality of said terminal-block locating formations which additionally constitute securing formations for cooperation with complementary locating and securing formations of said row of terminal blocks so as to hold said locating member assembled to said terminal blocks.

14. Apparatus as in claim 11 wherein at least some of said group of terminal blocks are multiple-circuit terminal blocks, each of said multiple-circuit terminal blocks having a plurality of said electrical terminals.

15. Apparatus as in claim 11, the row of equipment terminals to which connections are to be made being a row of printed-circuit terminals on a printed-circuit board, there being a row of holes distributed along the row at modular intervals extending through the printed-circuit terminals and said electrical terminals of the terminal blocks being pin terminals distributed along the row for entry into said holes for connection to said printed-circuit terminals.

16. Apparatus as in claim 11 wherein said locating formations additionally constitute detents for securing said formations to said terminal blocks.

17. A method of providing terminal blocks for electrical equipment having terminals that are distributed in inch-based or millimeter-based modular intervals, including the steps of assembling a row of terminal blocks having respective terminals, the terminals of each terminal block being so limited in number and each terminal being so located on its respective terminal block that the terminals of said terminal blocks are cooperable with respective equipment terminals regardless of whether the distribution of the equipment terminals is at inch-based or metric-based modular intervals, the terminal blocks and their terminals being movable relatively closer together and farther apart, selecting an elongated locating member out of two kinds that have locating formations cooperable with said terminal blocks to determine the distribution thereof, the modular distribution of the locating formations being inch-based for one kind of locating member and being millimeter-based for the other kind, and securing the selected elongated locating member to the row of terminal blocks.

18. Apparatus as in claim 1, wherein said retaining means comprises interlocking portions of the terminal blocks of the apparatus.

19. Apparatus as in claim 9, wherein the terminal blocks of said first row are offset from the terminal blocks of the second row relative to the length of the parallel rows so that each said subassembly includes a portion of a terminal block in one row that overlaps a portion of a terminal block that (a) is in said second row, and (b) is part of next-adjacent subassembly, said interengaging formations being provided on said overlapping portions.

20. Apparatus as in claim 9, further including means comprising at least one elongated member having locating formations cooperating with each of said unitary subassemblies for establishng that spacing of the terminals of said terminal blocks which corresponds to the distribution of the terminals of one of said forms of electrical equipment.

21. Apparatus for making electrical connections to electrical equipment having at least one row of many equipment terminals whose distribution is alternatively at inch-based or metric-based modular intervals along the row, said apparatus including at least one group of terminal blocks having electrical terminals which are distributed along a row and which are proportioned for cooperation with said equipment terminals, respectively, said terminal blocks having wire fastening terminals connected to said electrical terminals, respectively, said terminal blocks being movable relative to one another along their row, the electrical terminals of each of said terminal blocks being so limited in number and each electrical terminal being so located on its respective terminal block that the terminals of the terminal blocks are cooperable with respective equipment terminals regardless of whether the distribution of the equipment terminals is at inch-based or metric-based modular intervals, and means for fixing the distribution of said terminal blocks along a row, said distribution-fixing means comprising two rows of fixedly-spaced locating formations, said rows of locating formations being selectively cooperable with said one row of terminal blocks, one of said rows of locating formations being distributed at inch-based modular intervals and the other of said rows of locating formations being distributed at metric-based modular intervals.

22. Electrical apparatus as in claim 21, including interengaging detent means on said row of terminal blocks and said means for fixing the distribution of said row of terminal blocks.

23. Apparatus as in claim 21, wherein at least some of said group of terminal blocks are multiple-circuit terminal blocks, each of said multiple-circuit terminal blocks having a plurality of said electrical terminals.

24. Apparatus as in claim 21, the row of equipment terminals to which connections are to be made being a row of printed-circuit terminals on a printed-circuit board, there being a row of holes distributed along the row at modular intervals extending through the printed-circuit terminals and through the printed-circuit board at those terminals, wherein the electrical terminals of said apparatus are projecting pin terminals for penetrating the holes through the printed-circuit board and for being soldered to the printed-circuit terminals, respectively and wherein, accordingly, the pin terminals of each of the terminal blocks are so limited in number and each pin terminal is so located on its terminal block as to be received in the row of holes in the printed-circuit board as aforesaid, regardless of whether the holes are distributed at inch-based or metric-based intervals.

25. Apparatus as in claim 21, wherein said locating formations additionally constitute detents for securing said formations to said terminal blocks.

26. Apparatus as in claim 21, wherein said means for fixing the distribution of the terminal blocks along a row comprises two elongated members which, respectively, bear said two rows of fixedly-spaced locating formations that are distributed at inch-based modular intervals and at metric-based modular intervals, respectively.

* * * * *